US010545434B2

(12) United States Patent
Portnoy et al.

(10) Patent No.: US 10,545,434 B2
(45) **Date of Patent: *Jan. 28, 2020**

(54) WET NULL CYCLE PRINTING

(71) Applicant: HP INDIGO B.V., Amstelveen (NL)

(72) Inventors: Vitaly Portnoy, Rehovot (IL); Michel Assenheimer, Kfar Sava (IL); Amiran Lavon, Bat Yam (IL); Eric G Nelson, Eagle, ID (US); Amir Ofir, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

This patent is subject to a terminal disclaimer.

(21) Appl. No.: 16/246,528

(22) Filed: Jan. 13, 2019

(65) Prior Publication Data

US 2019/0146384 A1 May 16, 2019

Related U.S. Application Data

(63) Continuation of application No. 15/500,336, filed as application No. PCT/EP2014/067096 on Aug. 8, 2015, now Pat. No. 10,191,416.

(51) Int. Cl.
*G03G 15/16* (2006.01)
*G03G 15/10* (2006.01)

(52) U.S. Cl.
CPC ..... *G03G 15/1665* (2013.01); *G03G 15/101* (2013.01)

(58) Field of Classification Search
CPC ..... G03G 15/1665
USPC ..... 399/66, 57, 60, 237
See application file for complete search history.

(56) References Cited

U.S. PATENT DOCUMENTS

| | | | | |
|---|---|---|---|---|
| 6,151,475 | A | 11/2000 | Uno | |
| 7,400,850 | B2 | 7/2008 | Romem | |
| 7,937,010 | B2 | 5/2011 | Yacoub et al. | |
| 10,191,416 | B2 * | 1/2019 | Portnoy | G03G 15/101 |
| 2007/0019996 | A1 | 1/2007 | Romem | |
| 2018/0239273 | A1 * | 8/2018 | Nelson | G03G 15/065 |
| 2019/0146378 | A1 * | 5/2019 | Borenstain | G03G 15/10 |

FOREIGN PATENT DOCUMENTS

JP 2000185670 7/2000

OTHER PUBLICATIONS

Bartolic, T. et al., Impact of Printing Additional Inks on Multicolor Reproduction in Liquid Toner Electrophotography, Jun. 27-29, 2013.

* cited by examiner

*Primary Examiner* — Christopher E Mahoney
(74) *Attorney, Agent, or Firm* — Steven R. Ormiston

(57) ABSTRACT

In an example, a method of wetting a print blanket includes receiving a null cycle trigger during a printing session. The method also includes maintaining printing voltages on a forecast BID (binary ink developer) that has been prepared to print a next color separation onto a photoreceptor, and applying wet null voltages to a non-forecast BID. The method then includes engaging the non-forecast BID with the photoreceptor to transfer fluid other than ink to the photoreceptor during the null cycle.

16 Claims, 3 Drawing Sheets

WET NULL CYCLE PRINTING

CROSS REFERENCE TO RELATED APPLICATIONS

This is a continuation of U.S. application Ser. No. 15/500,336 filed Jan. 30, 2017 which is a Section 371 national stage of international application no. PCT/EP2014/067096 filed Aug. 8, 2014.

BACKGROUND

The photography (EP) printing devices form images on print media by placing a uniform electrostatic charge on a photoreceptor and then selectively discharging the photoreceptor in correspondence with the images. The selective discharging forms a latent electrostatic image on the photoreceptor. Colorant is then developed onto the latent image of the photoreceptor, and the colorant is ultimately transferred to the media to form the image on the media. In dry EP (DEP) printing devices, toner is used as the colorant, and it is received by the media as the media passes below the photoreceptor. The toner is then fixed in place as it passes through heated pressure rollers. In liquid EP (LEP) printing devices, ink is used as the colorant instead of toner. In LEP devices, an ink image developed on the photoreceptor is offset to an image transfer element, where it is heated until the solvent evaporates and the resinous colorants melt. This image layer is then transferred to the surface of the print media being supported on a rotating impression drum.

Non-productive print cycles, typically referred to as null cycles, can occur before, during, and after (i.e., in between) normal printing sessions. During such non-productive cycles, images are not being written to the photoreceptor or transferred to the image transfer element. The lack of image transfers during such non-productive cycles can damage the image transfer element and reduce print quality.

BRIEF DESCRIPTION OF THE DRAWINGS

The present embodiments will now be described, by way of example, with reference to the accompanying drawings, in which.

Throughout the drawings, identical reference numbers designate similar, but not necessarily identical, elements.

DETAILED DESCRIPTION

Figure 1:
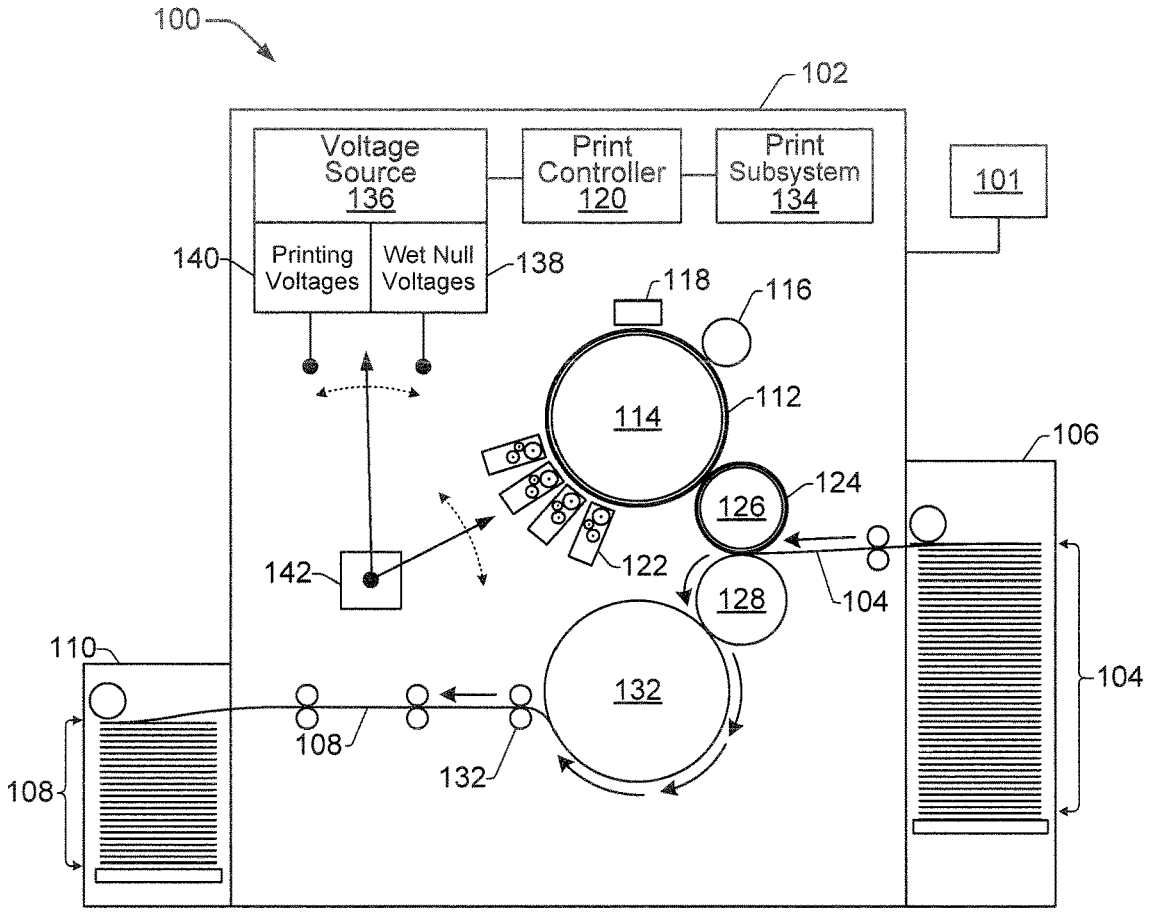
FIG. 1 shows an example of a printing device suitable for selecting a BID (binary ink developer) to perform "wet nulls" while reducing background image transfer and maintaining a forecast BID in a print-ready condition.

The following description provides illustrative examples of an apparatus and printing process associated with an LEP printing process. However, the examples are presented for the purpose of illustration rather than limitation, and they may therefore be applicable to printing processes other than the LEP printing process described below. An LEP printing device implemented as a digital offset press uses electrically charged ink with a thermal offset print blanket. In an LEP printing press, the surface of a photo imaging component is uniformly charged and then selectively discharged to form a latent electrostatic image. The photo imaging component is often referred to as a "photoconductor" or a "photoreceptor", and it will be referred to as such for the remainder of this description. The latent electrostatic image is formed on the photoreceptor using photo-induced electric conductivity and a laser beam that discharges the electro-statically charged photoreceptor in a pattern consistent with the image. Charged liquid ink from a binary ink developer ("BID") is then applied to the surface of the photoreceptor and develops onto the latent electrostatic image, forming an ink image. In general, BIDs have a "development function" that develops the ink onto the photoreceptor and a "cleaning function" that removes residual ink from BID rollers. Each BID has several internal rollers and surfaces that are each differentially electrified with voltages, collectively referred to herein as "printing voltages". A developer roller within the BID is coated with a layer of charged liquid ink particles and the developer roller of the BID engages the surface of the photoreceptor. The developer roller is at a voltage level in between the maximum and minimum voltage of the photoreceptor, and as the developer roller and photoreceptor roller rotate against one another, different portions of the charged ink layer progressively come into contact with the photoreceptor at a nip between the two rollers. Charged ink on the developer roller is attracted to locations on the photoreceptor where surface charge has been neutralized by the laser, and repelled from locations on the photoreceptor where surface charge has not been neutralized by the laser. This initial transfer of ink from the BID developer to the photoreceptor produces a developed ink image on the surface of the photoreceptor, and is often referred to as the "zero transfer".

The ink image is then transferred from the surface of the photoreceptor to an intermediate transfer member (ITM), referred to herein as the "blanket", or "print blanket". The print blanket is wrapped around and attached securely to an ITM drum/cylinder. Transferring the ink image from the photoreceptor to the print blanket is often referred to as the "first transfer". Transfer of the ink image from the photoreceptor to the print blanket in the first transfer is driven by rolling nip contact forces (i.e., between the photoreceptor and the blanket) and electrophoresis of the electrically charged ink particles. The electric field between the photoreceptor and print blanket that drives the ink transfer is created by a bias voltage applied to the print blanket. In addition to having a bias voltage applied to it, the blanket is heated and maintained at a high temperature in order to evaporate carrier liquid present in the ink such as solvents and to partially melt and blend solid ink particles. The high blanket temperature, along with contact pressure between the blanket and an impression drum, facilitate a "second transfer" of the image onto the print media. In the second transfer, the ink image is transferred from the print blanket to the print media (e.g., sheet paper, web paper) supported on the impression (IMP) drum through heat and contact pressure between the ITM drum and the IMP drum.

Throughout the printing process, the print blanket encounters a number of wear mechanisms that cause damage to the blanket. Damage to the print blanket eventually has a negative impact on the quality of the printed output. Therefore, such wear mechanisms effectively shorten the useful lifespan of the blanket, since printing press operators typically replace print blankets when the print quality begins to suffer. Unfortunately, replacing print blankets is expensive and reduces printer output efficiency because of the time involved in the replacement process.

One common blanket wear mechanism is referred to as blanket memory. Blanket memory can cause damage to a blanket through the continual placement of the same or similar images in the same position on the blanket. If an image is printed many times (i.e., the same or similar image), so that ink is repeatedly applied to the same areas of the blanket while being repeatedly left off of other areas of the blanket, there is differential damage between the areas in which ink is applied and areas in which ink is not applied. Subsequently, when a different image is printed that calls for the application of ink onto the blanket in areas where ink has or has not been previously applied, the appearance of the printed image varies between those areas.

Another blanket wear mechanism is the repeated pressing of the print media against the print blanket. Mechanical wear of the blanket is caused by the direct interaction of the print media (paper) on the IMP drum with the blanket. Under normal printing conditions, the ITM drum and IMP drum are engaged so as to bring the print blanket and print media into contact. The ITM and IMP drums are compressed together and can have a contact force between them, for example, on the order of 300 to 400 kilogram force. The repeated high pressure contact between the blanket and the print media held on the IMP drum can cause the sharp edges of the media to cut into the blanket release layer. Subsequently, when images are printed in areas that extend beyond the cut marks (e.g., when a larger image is printed), the ink in the cut-mark areas does not transfer well to the print media, and the cut-marks become visible as defects on the printed output.

Null cycles are non-productive cycles that can exacerbate the damaging effects of these wear mechanisms, as well as cause another blanket wear mechanism, which is the drying of the print blanket. Normal printing is suspended within the press when a null cycle is triggered, for example, by an interrupt from a printing subsystem. During a null cycle, the printing press operates as if normal printing is being performed, but there is actually no image development or image transfer taking place. During a null cycle, most of the printing components remain operational so that when the next print cycle begins, these components are ready to resume writing and transferring images as normal. For example, in a null cycle, the photoreceptor drum, ITM drum, and IMP drum, will continue to spin. However, during a null cycle there is no latent electrostatic image written onto the photoreceptor, and no BIDs engaging the photoreceptor. Therefore, there is no "zero transfer" in which ink, solvents, oil, or other fluids are being transferred from the BID to the photoreceptor. Consequently, there is also no "first transfer" of images, ink, solvents, oil, or other fluids from the photoreceptor to the print blanket. However, during the null cycle the heating and charging of the print blanket may continue so that the blanket will be ready when normal print cycles resume. Unfortunately, the continued heating and charging of the blanket coupled with the lack of fluid transfer to the blanket cause the blanket to become dry and sticky, which can damage the blanket and have a negative impact on the transfer of images and the overall print quality. In longer null cycle sequences, the print blanket can become very sticky and lose releasability, leading to a loss of ink transfer and/or the paper sticking to the blanket.

Null cycles can occur within the press in a number of circumstances. For example, the press can insert null cycles following a printing session (i.e., a print job), after the final color separation for the session has printed, but before the press receives instructions on what will be printed next. In this case, the press will perform null cycles while waiting for instructions or data from a subsequent print job that indicate what color separation will be printed next. The press can also insert null cycles between printing cycles (i.e., between color separations) during a printing session when an interrupt or trigger is received from a printing subsystem. For example, as an image in a current print cycle is transferred from the print blanket to the print media during normal printing, an interrupt can be received from a printing subsystem that causes insertion of a null cycle. An interrupt that triggers a null cycle can be generated by various printing subsystems as a way to inform the print controller within the press that the subsystem is not ready to continue with normal printing. For example, during normal printing, a sensor in the print media transport system may detect that the print media has not arrived at a particular location along the media transport path by a designated instant in time. The detection by the media transport system of such a media timing issue can serve as an interrupt to the print controller within the press that triggers a null cycle. For each subsequent print cycle during which the interrupt from the media transport system persists, an additional null cycle can be inserted to continue suspending the normal printing process. In another example, while performing a color calibration, the printing press can insert null cycles into the printing process while it waits for an inline densitometer/spectrophotometer to measure a printed page before it prints a next page.

In any case, as noted above, a null cycle can result in drying of the print blanket, referred to as a "dry null", which contributes to print blanket damage and diminished print quality. One way to avoid the problem of the "dry null", is to wet the blanket during the null cycle by performing a "wet null". In general, a "wet null" includes engaging a BID (binary ink developer) to wet the photoreceptor (e.g., with ink, solvents, oil, or other carrier fluids from the BID such as Isopar®L), which in turn wets the print blanket. However, during normal printing, BIDs are activated one at a time to ensure that color separations are printed sequentially, and the BID for each color separation is prepared ahead of time. This creates a timing issue that complicates the choice for which BID to use to perform the "wet null".

During normal printing sessions, forecasts provide notifications for upcoming color separations. Therefore, while printing a current color separation, a forecast color separation effectively identifies which color BID will print the next color separation. The BID identified for printing the next color separation is referred to herein as the "forecast BID", while the BIDs that have not been identified for printing the next color separation are referred to as "non-forecast BIDs". A forecast BID is prepared with printing voltages at least one color separation ahead of the time, which enables the forecast BID to perform the "zero transfer" of ink from the BID to the photoreceptor for the forecast color separation. Thus, when a null cycle trigger is received, one option for selecting which BID to use for the "wet null" would be to choose the forecast BID that has already been prepared with printing voltages. Unfortunately, using the prepared forecast BID for the "wet null" is undesirable for several reasons, as explained below.

Typically, an LEP press includes at least four BID stations, one for each of the four ink colors, yellow (Y), magenta (M), cyan (C), and black (K), that are used to produce multi-color images. Other press implementations can include additional BID stations to provide, for example, additional special colors. In a four color printing process, the normal order or sequence for printing color separations is Y, then M, then C, then K. For example, while a current M color separation is being printed, the C color BID will be the next BID (i.e., the forecast BID) and it will be prepared with printing voltages ahead of time to print the next, forecast color separation. Furthermore, in a four color printing process, null cycle triggers usually occur just prior to the next Y color separation to be printed. Therefore, during a normal printing session when a null cycle trigger is received, the forecast color separation will be a Y color separation, and the Y BID will be the forecast BID that has already been prepared with printing voltages as the current separation is being printed.

However, as mentioned above, choosing this previously prepared forecast BID (e.g., the Y BID) to perform a "wet null" is undesirable. One reason using the forecast BID for the "wet null" is undesirable is because this will result in printing a background image onto the photoreceptor. A background image is an undesirable print quality artifact, and it can continue to accumulate if there are numerous null cycles that occur in a sequence. Thus, portions of background transferred to the photoreceptor will accumulate in the filters of the fluid cleaning system, and end up on the blanket surface and on the media pages. To avoid printing such a background image, the printing voltages applied to the forecast BID can be "turned off". As discussed below, "turning off" the BID printing voltages is intended to indicate changing the BID voltages to special, "wet null" voltages, that result in essentially zero current between different roller nips within the BID and between the BID developer roller and the photoreceptor. "Turning off" the printing voltages to the forecast BID enables the transfer of wetting substances (e.g., solvents, oil, or other carrier fluids) from the BID to the photoreceptor while avoiding the transfer of ink particles to the photoreceptor, which prevents the background image from being printed.

Unfortunately, turning off the printing voltages to the forecast BID is also undesirable, because this results in the forecast BID being unprepared to print the next separation when the null cycles come to an end and printing resumes. More specifically, if the printing voltages are turned off to the forecast BID to achieve a "wet null" that avoids printing a background image, then the forecast BID (which is the BID identified to print the next color separation) will not be prepared with printing voltages to print the next color separation when printing resumes. In this situation, the press will insert another null cycle to allow the forecast BID to be prepared with printing voltages, and a potentially endless series of null cycles will ensue.

Accordingly, example systems and methods described herein consider the printing order and timing of the BIDs in order to maintain a forecast BID in a print-ready condition during null cycles, while engaging a non-forecast BID to perform a "wet null" and adjusting the non-forecast BID voltages to minimize BID currents and reduce the transfer of background artifacts. Wet null voltages applied to a non-forecast BID minimize currents so there is little or no electric field within the BID and between the BID and photoreceptor, resulting in no background ink transfer to the photoreceptor during the "wet null". However, engaging the BID with the photoreceptor still permits oil or other carrier fluid (unaffected by electric field) to wet the photoreceptor by contact. In response to a null cycle trigger, the wet null voltages are applied to non-forecast BIDs that have not been prepared with printing voltages, while printing voltages are maintained on a previously prepared forecast BID to ensure that the forecast BID remains ready to resume printing when the null cycle or series of null cycles comes to an end. One of the non-forecast BIDs with the applied special wet null voltages can then be selected to engage the photoreceptor to perform the "wet null".

In some examples, such as at the end of a print job, there is no forecast indicating which color separation is to be printed next. In this case, a null cycle is triggered at the end of a print job while the press waits for print information from the next print job. The BID selected in this case to perform "wet nulls" depends on which BID was used to print the last color separation of the print job. For example, considering that the normal order for printing color separations is Y, then M, then C, then K, the BID selected for the "wet null" would typically not be of the color that follows the last color separation printed, because this would increase the chance that the selected "wet null" BID would be the same as the next forecast BID. In the event that the BID selected to perform the "wet nulls" ends up being the next forecast BID (i.e., the BID identified by the first forecast color separation from the next print job), the press stops performing the wet nulls and inserts a null cycle to enable the forecast BID to be prepared with printing voltages so that it can print the next color separation.

In one example, a method of wetting a print blanket includes, receiving a null cycle trigger during a printing session. The method includes maintaining the printing voltages on a forecast BID that has been previously prepared for printing a next color separation onto a photoreceptor, and applying wet null voltages to a non-forecast BID. The non-forecast BID with the wet null voltages is then engaged with the photoreceptor to transfer fluid, other than ink, to the photoreceptor during the null cycle.

In another example, a printing device includes a voltage source that includes printing voltages and wet null voltages. The printing device also includes a forecast BID to print a next color separation to the photoreceptor and a plurality of non-forecast BI Ds. The printing device includes a controller to apply the printing voltages to the forecast BID in preparation for printing the next color separation, and to apply the wet null voltages to the non-forecast BIDs in response to receiving a null cycle trigger.

In another example, a non-transitory machine-readable storage medium stores instructions that when executed by a processor of a printing device, cause the printing device to print a last color separation of a print job using a current BID. The instructions further cause the printing device to trigger a null cycle upon recognizing there is no forecast available for a next color separation. The instructions also cause the printing device to select a wet null BID to perform a wet null for the null cycle. Thereafter, a forecast is received identifying the next color separation to be printed and a forecast BID to be used. If the forecast BID is not the same as the selected wet null BID, the processor causes the printing device to prepare the forecast BID with printing voltages while the selected wet null BID performs the wet null cycle. However, if the forecast BID is the same as the selected wet null BID, the printing device stops performing the wet null cycle with the wet null BID, inserts at least one additional null cycle, and prepares the forecast BID with printing voltages during the additional null cycle.

FIG. 1 illustrates an example of a printing device 100 suitable for selecting a BID to perform "wet nulls" while reducing background image transfer and maintaining a forecast BID in a print-ready condition. The printing device 100 comprises a print-on-demand device, implemented as a liquid electro-photography (LEP) printing press 100. An LEP printing press 100 generally includes a user interface 101 that enables the press operator to manage various aspects of printing, such as loading and reviewing print jobs, proofing and color matching print jobs, reviewing the order of the print jobs, and so on. The user interface 101 typically includes a touch-sensitive display screen that allows the operator to interact with information on the screen, make entries on the screen, and generally control the press 100. The user interface 101 may also include other devices such as a key pad, a keyboard, a mouse, and a joystick, for example.

An LEP printing press 100 includes a print engine 102 that receives a print substrate, illustrated as print media 104 (e.g., cut-sheet paper) from a media input mechanism 106. After the printing process is complete, the print engine 102 outputs the printed media 108 to a media output mechanism, such as a media stacker tray 110. The printing process is generally controlled by a print controller 120 to generate the printed media 108 using digital image data that represents words, pages, text, and images that can be created, for example, using electronic layout and/or desktop publishing programs. Digital image data is generally formatted as one or multiple print jobs that are stored and executed on the print controller 120, as further discussed below with reference to FIG. 2.

The print engine 102 includes a photo imaging component, such as a photoreceptor 112 mounted on a photoreceptor/imaging drum/cylinder 114. The photoreceptor 112 defines an outer surface of the imaging drum 114 on which images can be formed. A charging component such as charge roller 116 generates electrical charge that flows toward the photoreceptor surface and covers it with a uniform electrostatic charge. The print controller 120 uses digital image print data and other inputs such as print job and print media parameters, temperatures, and so on, to control a laser imaging unit 118 to selectively expose the photoreceptor 112. The laser imaging unit 118 exposes image areas on the photoreceptor 112 by dissipating (neutralizing) the charge in those areas. Exposure of the photoreceptor in this manner creates a 'latent image' in the form of an invisible electrostatic charge pattern that replicates the image to be printed.

After the latent electrostatic image is formed on the photoreceptor 112, the image is developed by a binary ink developer (BID) 122 to form an ink image on the outer surface of the photoreceptor 112. Each BID 122 includes several rollers that facilitate the development of ink to the latent electrostatic image. Controller 120 can apply printing voltages 140 from a voltage source 136 to a BID 122 through a voltage application mechanism 142 such as a switch, to charge ink particles in the BID and create electric fields between the BID and photoreceptor that enable the development of ink to the latent electrostatic image. Voltage source 136 is intended to represent a plurality of sources that provide individual voltages to the BID for differentially electrifying surfaces and several rollers within the BID. Accordingly, the application mechanism 142 can include a plurality of application mechanisms suitable for applying individual voltages within the BID. For example, application mechanism 142 may accommodate differences in timing while changing the individual voltages within the BID when transitioning back and forth between printing voltages and wet null voltages. Each BID 122 also includes a cleaning function to clean ink off of rollers that does not transfer to the photoreceptor. Each BID 122 develops one ink color of the image, and each developed color corresponds with one image impression or color separation. While four BIDs 122 are shown, indicating a four color process (i.e., a CMYK process), other press implementations may include additional BIDs 122 corresponding to additional colors. In addition, although not illustrated, print engine 102 also includes erase and cleaning mechanisms that are generally incorporated as part of any electrophotographic process.

In a first image transfer, the single color separation impression of the ink image developed on the photoreceptor 112 is transferred from the photoreceptor 112 to an image transfer blanket 124. The image transfer blanket 124 is primarily referred to herein as the print blanket 124 or blanket 124. The print blanket 124 is wrapped around and securely fastened to the outer surface of the intermediate transfer member (ITM) drum 126. The first image transfer that transfers ink from the photoreceptor 112 to the print blanket 124 is driven by an applied mechanical pressure between the imaging drum 114 and the ITM drum 126, and electrophoresis of the electrically charged ink particles. The electric field that drives the ink transfer is created by a bias voltage applied to the print blanket 124. Both the blanket bias voltage and the mechanical pressure between the imaging drum 114 and ITM drum 126 can impact the image transfer quality.

The print blanket 124 is heated by both internal and external heating sources such as infrared heating lamps (not shown). The heated print blanket 124 causes most of the carrier liquid and solvents in the transferred ink image to evaporate. The heated blanket 124 also causes the particles in the ink to partially melt and blend together. This results in a finished ink image on the blanket 124 in the form of a hot, nearly dry, tacky plastic ink film. In a second image transfer, this hot ink film image impression is then transferred from the blanket 124 to a substrate such as a sheet of print media 104 (e.g., paper), which is held or supported by an impression (IMP) drum/cylinder 128. Contact pressure between the ITM drum 126 and IMP drum 128 compresses the blanket 124 against the print media 104 to facilitate the transfer of the hot ink film image. The temperature of the print media 104 is below the melting temperature of the ink particles, and as the ITM drum 126 and IMP drum 128 rotate against one another under pressure, the hot ink film comes into contact with the cooler print media 104 and causes the ink film to solidify and peel off from the blanket 124 onto the print media 104.

This process is repeated for each color separation in the image. In a 4-shot printing process, the colors accumulate in successive revolutions on the print media 104 wrapped on the impression drum 128 until all the color separation impressions (e.g., C, M, Y, and K) in the image are transferred to the print media 104. After all the color impressions have been transferred to the sheet of print media 104, the printed media 108 sheet is transported by various rollers 132 from the impression drum 128 to the output mechanism 110. In a 1-shot printing process, the color separations accumulate on the print blanket 124 and are transferred to the print media at one time after all the color separations have been transferred to the blanket.

As mentioned above, null cycles can be triggered both during a print job/session, and after a print job has finished printing, as the press 100 waits for additional printing information from a next print job. A null cycle trigger can comprise an interrupt generated by a printing subsystem 134, such as a color calibration subsystem or media transport subsystem. Such subsystem interrupts provide an error indication to the print controller 120 that the subsystem 134 is not ready to continue normal printing. An interrupt, or trigger, results in the controller 120 inserting one or more null cycles that cause the press 100 to suspend normal printing until the subsystem triggering the null cycles is ready to resume printing. In some cases the controller 120 can continue to insert null cycles into the printing process until the controller 120 detects that the subsystem interrupt has terminated or is no longer present. In some examples, when enough consecutive null cycles are inserted, the controller 120 can eventually cause the press to "time-out" and put the press into a standby mode in which, for example, the drums stop rotating and certain printing subsystems enter an off or "sleep"-like state. As noted above, the press 100 can take certain actions before and during a null cycle to keep the print blanket 124 from drying during the null cycle, which helps to avoid damage to the blanket and diminished print quality from the press.

Figure 2:
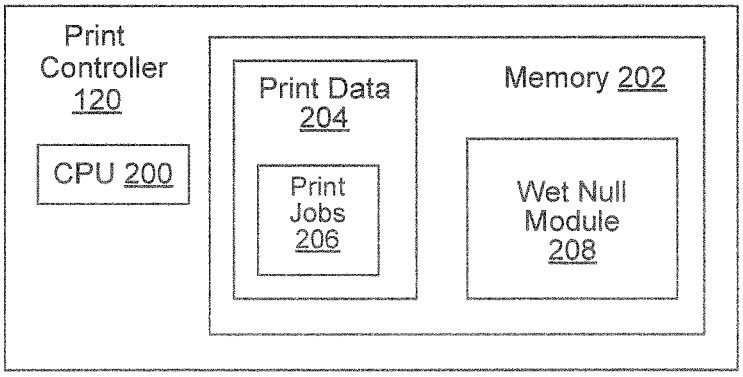
FIG. 2 shows a box diagram of an example print controller suitable for use within an LEP printing press to control a printing process, and to prepare and manage BIDs to perform "wet nulls" during null cycles that keep the print blanket from drying out.

FIG. 2 shows a box diagram of an example print controller 120 suitable for use within an LEP printing press 100 to control a printing process, and to prepare and manage BIDs 122 to perform "wet nulls" during null cycles that keep the print blanket 124 from drying out. Referring generally to FIGS. 1 and 2, print controller 120 comprises a processor (CPU) 200 and a memory 202, and may additionally include firmware and other electronics for communicating with and controlling the other components of print engine 102, the user interface 101, and media input (106) and output (110) mechanisms. Memory 202 can include both volatile (i.e., RAM) and nonvolatile (e.g., ROM, hard disk, optical disc, CD-ROM, magnetic tape, flash memory, etc.) memory components. The components of memory 202 comprise non-transitory, machine-readable (e.g., computer/processor-readable) media that provide for the storage of machine-readable coded program instructions, data structures, program instruction modules, JDF (job definition format), and other data for the printing press 100, such as module 208. The program instructions, data structures, and modules stored in memory 202 may be part of an installation package that can be executed by processor 200 to implement various examples, such as examples discussed herein. Thus, memory 202 may be a portable medium such as a CD, DVD, or flash drive, or a memory maintained by a server from which the installation package can be downloaded and installed. In another example, the program instructions, data structures, and modules stored in memory 202 may be part of an application or applications already installed, in which case memory 202 may include integrated memory such as a hard drive.

As noted above, print controller 120 uses digital image data and other inputs to control the laser imaging unit 118 in the print engine 102 to selectively expose the photoreceptor 112. More specifically, controller 120 receives digital print data 204 from a host system, such as a computer, and stores the data 204 in memory 202. Data 204 represents, for example, documents or image files to be printed. As such, data 204 forms one or more print jobs 206 for printing press 100 that each include print job commands and/or command parameters. Using a print job 206 from data 204, print controller 120 controls components of print engine 102 (e.g., laser imaging unit 118) to form characters, symbols, and/or other graphics or images on print media 104 through a printing process as has been generally described above with reference to FIG. 1.

A wet null module 208 comprises program instructions stored in memory 202 and executable on processor 200 to cause the print controller 120, and/or printing press 100, to receive/detect an interrupt from a subsystem 134 and to initiate various actions in response to the interrupt. For example, during normal printing the controller 120 can receive an interrupt and use it as a trigger to insert a null cycle into the printing process, and to perform a "wet null" to keep the print blanket 124 wet during the null cycle. In one example, in response to the trigger, the print controller 120 can apply wet null voltages 138 from voltage source 136 (e.g., via a voltage switching mechanism 142) to one or multiple non-forecast BIDs 122 that have not been previously prepared with printing voltages 140. In addition, to maintain a forecast BID 122 in a print-ready condition, the controller 120 can continue the application of printing voltages 140 to the forecast BID 122.

Printing voltages 140 can comprise differential voltages that are set through a color calibration process and applied to different components within a BID 122 (e.g., rollers, electrode, squeegee, cleaner, and other surfaces). The printing voltages 140 charge ink particles within the ink carrier fluid (e.g., solvents, oil, or other fluids) and create an electric field between the BID and photoreceptor enabling the transfer of charged ink particles to the photoreceptor through contact force and electrophoresis of the electrically charged ink particles. Ink carrier fluid is also transferred to the photoreceptor through the contact. Some typical printing voltages that may be applied to different components within a forecast BID could include, for example, −400V on the developer roller, −700V on the squeegee, −1200V on the electrode, and −200V on the cleaner. By contrast, wet null voltages 138 applied to components within a BID are typically not differential voltages, but are instead voltages set at levels designed to generate little or no current between the components so as to prevent electric field and the charging and transfer of ink particles. Wet null voltages 138 are set so as not to oppose normal voltage polarities in the normal printing session or reverse the normal directions of the electric fields. That is, if under normal printing conditions the electric field is from roller A to roller B (within the BID), then having little or no current means reducing the strength of the electric field between roller A and roller B, but not causing even a slight opposite electric field. Thus, having a slight (non-zero) electric field of the same polarity than the normal electric field is better than reversing the electric field even a slight amount. Because there is little or no electric field between the BID and photoreceptor, no ink particles are transferred during a wet null. However, ink carrier fluid (without the ink particles) still transfers to the photoreceptor during the wet null. A typical example of applying wet null voltages may include applying a single voltage of approximately 750V (or other voltage value within a range of approximately 500-800V) to one or all of the non-forecast BIDs. In one example, all BID voltages except for a forecast BID can be set together to the wet null voltages.

Instructions from the wet null module 208 can further execute to cause the print controller 120 to select and engage one of the non-forecast BIDs 122 to perform the "wet null" which will keep the print blanket 124 wet during the null cycle. Non-forecast BIDs can include any BID 122 that is not forecast to print a next color separation. Thus, non-forecast BIDs can include any of the primary BID colors, CMYK, in a four-color LEP printing process, or any other special color BID that may be available on the press 100. In a monochrome printing process where a single BID (e.g., the K BID) is engaged for each print cycle, the non-forecast BID selected for performing wet nulls can be any other BID that is not the monochrome color, which can mean that the print cycles and null cycles alternate back and forth between two BIDs.

In some examples, at the end of a print job when a final color separation is being printed, there is no forecast available to the print controller 120 to identify a next color separation. This lack of print information can serve as a trigger to the print controller 120 to cause it to insert null cycles while waiting for additional print information from a next print job. In this scenario, instructions from the wet null module 208 execute to cause the print controller 120 to select a BID to perform wet nulls during the inserted null cycles. The selection of the BID to perform the wet nulls can be based on the normal order for printing color separations, and which color BID 122 was used to print the final color separation from the last print job. As noted above, since the normal order for printing color separations is Y, then M, then C, then K, the BID selected for the wet null would typically not be of the color that follows the last color separation printed, because this would increase the chance that the selected "wet null" BID would be the same as the next forecast BID. It is noted that while one order for printing color separations has been provided, other print color orders are possible. The printing color order provided is one that applies to the majority of print jobs (e.g., 90% of print jobs). Furthermore, in some examples, a spot or special color BID can be selected for the wet null if such BIDs have been installed. Not all print jobs will contain such specially installed colors, so spot or special color BIDs are typically employed at low duty cycles. Therefore, selecting such BIDs for wet nulls would increase their duty cycles and help circulate the special inks through these BIDs, having an additional advantage of decreasing damage to such special color BIDs.

Because the printing color order does not always follow a normal order as noted above, it is possible that the BID selected to perform the wet nulls will be the same as the next BID forecast to print the next color separation from the next print job. In the event that the BID selected to perform the "wet nulls" ends up being the next forecast BID, instructions from the wet null module 208 execute to cause the press 100 to stop performing the wet nulls and to insert a null cycle to enable the forecast BID to be prepared with printing voltages so that it can print the next color separation. Under these circumstances, the null cycle inserted to prepare the forecast BID will be a "dry null".

Figure 3:
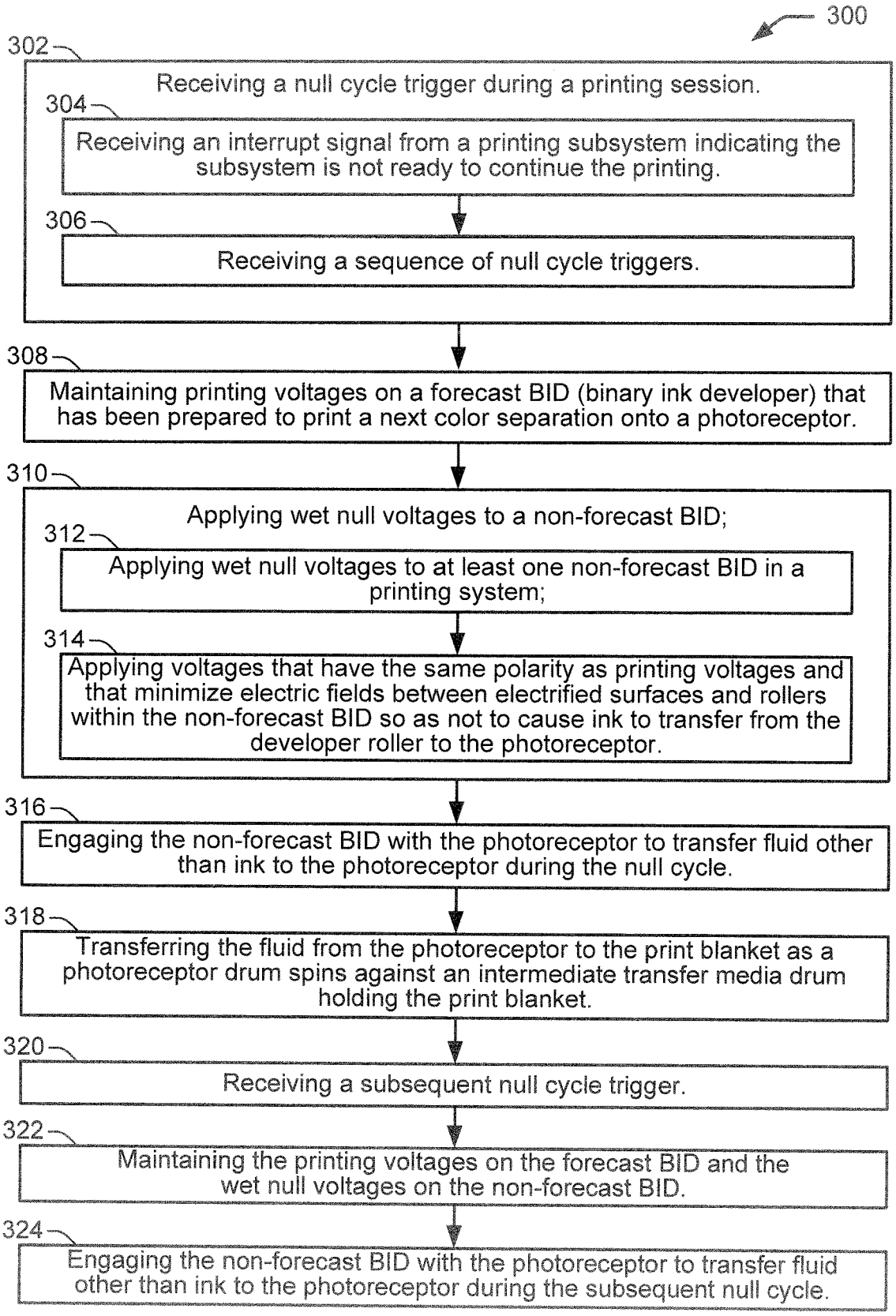
FIGS. 3 and 4 show flow diagrams that illustrate example methods related to preparing and managing BIDs to perform "wet nulls" during null cycles in order to keep the print blanket from drying out.
Figure 4:
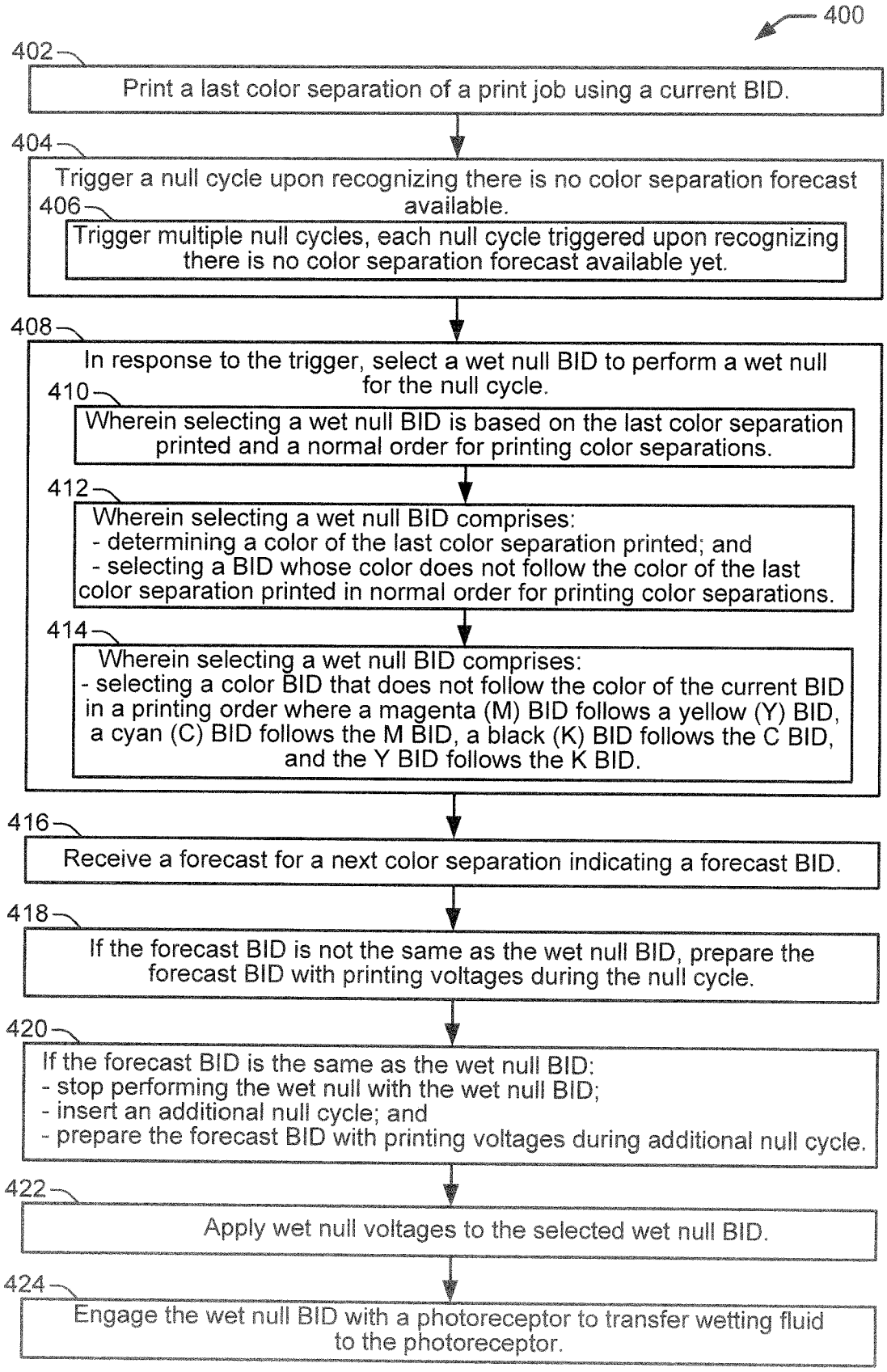

FIGS. 3 and 4 show flow diagrams that illustrate example methods 300 and 400, related to preparing and managing BIDs 122 to perform "wet nulls" during null cycles in order to keep the print blanket 124 from drying out. Methods 300 and 400 are associated with the examples discussed above with regard to FIGS. 1 and 2, and details of the operations shown in methods 300 and 400 can be found in the related discussion of such examples. The operations of methods 300 and 400 may be embodied as programming instructions stored on a non-transitory, machine-readable (e.g., computer/processor-readable) medium, such as memory 202 of printing press 100 as shown in FIGS. 1 and 2. In some examples, implementing the operations of methods 300 and 400 can be achieved by a processor, such as processor 200 of FIG. 2, reading and executing the programming instructions stored in memory 202. In some examples, implementing the operations of methods 300 and 400 can be achieved using an ASIC (application specific integrated circuit) and/or other hardware components alone or in combination with programming instructions executable by processor 200.

Methods 300 and 400 may include more than one implementation, and different implementations of methods 300 and 400 may not employ every operation presented in the respective flow diagrams. Therefore, while the operations of methods 300 and 400 are presented in a particular order within the flow diagrams, the order of their presentation is not intended to be a limitation as to the order in which the operations may actually be implemented, or as to whether all of the operations may be implemented. For example, one implementation of method 300 might be achieved through the performance of a number of initial operations, without performing one or more subsequent operations, while another implementation of method 300 might be achieved through the performance of all of the operations.

Referring now to the flow diagram of FIG. 3, an example method 300 of wetting a print blanket 124 begins at block 302, with receiving a null cycle trigger during a printing session. In some examples, receiving a null cycle trigger includes receiving an interrupt signal from a printing subsystem indicating the subsystem is not ready to continue the printing, as shown at block 304. In some examples, as shown at block 306, receiving a null cycle trigger can include receiving a sequence of null cycle triggers. As shown at block 308, the method 300 includes maintaining printing voltages on a forecast BID (binary ink developer) that has been prepared to print a next color separation onto a photoreceptor. Maintaining the forecast BID with printing voltages keeps the BID in a print-ready condition so that it can print the next forecast separation when the null cycle(s) ends and printing resumes.

As shown at block 310, method 300 includes applying wet null voltages to a non-forecast BID. Applying wet null voltages to a BID is typically done in response to receiving a null cycle trigger, in preparation for the BID to perform a "wet null" that helps to keep the print blanket wet during the null cycle. In some examples, applying wet null voltages includes applying wet null voltages to at least one non-forecast BID in the printing system as shown at block 312. As shown at block 314, applying wet null voltages also includes applying voltages that have the same polarity as printing voltages and that minimize electric fields between electrified surfaces and rollers within the non-forecast BID, so as not to cause ink to transfer from the developer roller to the photoreceptor. As noted above, wet null voltages are selected so as not to reverse the normal directions of the electric fields, and to apply negligible electric fields (or zero current) between the electrified rollers and surfaces within the BID.

The method 300 can continue at block 316, with engaging the non-forecast BID with the photoreceptor to transfer fluid other than ink to the photoreceptor during the null cycle. As shown at block 318, the method includes transferring the fluid from the photoreceptor to the print blanket as a photoreceptor drum spins against an intermediate transfer media drum holding the print blanket. As shown at block 320, the method can include receiving a subsequent null cycle trigger, and as shown at blocks 322 and 324, respectively, the method 300 can then include maintaining the printing voltages on the forecast BID and the wet null voltages on the non-forecast BID for the subsequent null cycle, and engaging the non-forecast BID with the photoreceptor to transfer fluid other than ink to the photoreceptor during the subsequent null cycle. In some examples, as noted above, when enough consecutive null cycles are received, the press can "time-out" and enter a standby mode.

Referring now to the flow diagram of FIG. 4, an example method 400 related to preparing and managing BIDs to perform "wet nulls" during null cycles begins at block 402, with printing a last color separation of a print job using a current BID. The method continues at block 404 with triggering a null cycle upon recognizing there is no color separation forecast. Thus, as the last color separation is printed for a current print job, a null cycle is triggered because there is no print information available yet that indicates what the next color separation will be for printing.

As shown at block 406, triggering a null cycle can include triggering multiple null cycles, each null cycle triggered upon recognizing there is no color separation forecast available yet.

As shown at block 408, in response to the trigger, a wet null BID is selected to perform a wet null for the null cycle. The selection of the BID to perform the wet null is based on the last color separation printed and the normal order for printing color separations, as shown at block 410. In some examples, as shown at block 412, selecting a wet null BID includes determining the color of the last color separation being printed, and selecting a BID whose color does not follow the color of the last color separation printed in normal order for printing color separations. That is, the BID selected for the wet null should not be of the color that is expected to be the next forecast BID. For example, as shown at block 414, selecting a wet null BID can include selecting a color BID that does not follow the color of the current BID in a printing order where a magenta (M) BID follows a yellow (Y) BID, a cyan (C) BID follows the M BID, a black (K) BID follows the C BID, and the Y BID follows the K BID.

The method 400 continues at block 416 with receiving a forecast for a next color separation that indicates a forecast BID. As shown at block 418, if the forecast BID is not the same as the selected wet null BID, the forecast BID is prepared with printing voltages during the null cycle. However, if the forecast BID and the selected wet null BID are the same BID, then the press stops performing the wet null with the selected wet null BID, and inserts an additional null cycle during which the forecast BID can be prepared with printing voltages to print the next/forecast color separation, as shown at block 420.

In the case where the forecast BID and selected wet null BID are not the same BID, wet null voltages are applied to the selected wet null BID, and the wet null BID is engaged with a photoreceptor to transfer wetting fluid to the photoreceptor, as shown at blocks 422 and 424, respectively.

What is claimed is:

1. A liquid electro-photographic printing device comprising:

a photoreceptor;

an intermediate transfer member to receive each of multiple successive color separations individually from the photoreceptor;

an impression drum to receive each of multiple successive color separations individually from the intermediate transfer member for transfer individually to a print substrate;

multiple binary ink developers each to print a different color separation to the photoreceptor;

a voltage source that includes printing voltages and wet null voltages;

a forecast one of the binary ink developers to print a next color separation to the photoreceptor;

a non-forecast one of the binary ink developers; and a controller to apply the printing voltages to the forecast binary ink developer in preparation for printing the next color separation and to apply the wet null voltages to the non-forecast binary ink developer in response to a null cycle trigger.

2. A printing device as in claim 1, wherein the wet null voltages have the same polarity as the printing voltages and a magnitude that reduces the strength of the corresponding electric field compared to the printing voltages.

3. A printing device as in claim 1, wherein the wet null voltages have the same polarity as the printing voltages and a magnitude of 500V-800V.

4. A printing device as in claim 1, wherein the forecast binary ink developer is a single one of the binary ink developers and the non-forecast one of the binary ink developers includes multiple non-forecast ones of the binary ink developers.

5. A printing device as in claim 1, wherein:

the non-forecast one of the binary ink developers comprises a first non-forecast one of the binary ink developers for a first null cycle trigger and a second non-forecast one of the binary ink developers different from the first one for a second null cycle trigger; and the controller is to apply to the wet null voltages to the first non-forecast binary ink developer in response to receiving the first null cycle trigger and to the second non-forecast binary ink developer in response to receiving the second null cycle trigger.

6. A printing device as in claim 1, further comprising a printing subsystem to generate the null cycle trigger when the subsystem senses it is not ready to perform a print cycle.

7. A method of wetting a bare print blanket, comprising:

triggering a null cycle during a printing session after transferring a color separation from the print blanket to a print substrate and before transferring a next color separation to the print blanket;

maintaining printing voltages on a forecast binary ink developer that has been prepared to print the next color separation onto a photoreceptor;

applying wet null voltages to a non-forecast binary ink developer; and during the null cycle, transferring fluid other than ink from the non-forecast binary ink developer to the photoreceptor and from the photoreceptor to the print blanket.

8. A method as in claim 7, wherein applying wet null voltages comprises applying voltages that have the same polarity as the printing voltages and reduce an electric field between electrified surfaces in the non-forecast binary ink developer compared to the printing voltages.

9. A method as in claim 7, further comprising:

before printing the next color separation, triggering a subsequent null cycle;

maintaining the printing voltages on the forecast binary ink developer and the wet null voltages on the non-forecast binary ink developer; and during the subsequent null cycle, transferring fluid other than ink from the non-forecast binary ink developer to the photoreceptor and from the photoreceptor to the print blanket.

10. A method as in claim 7, wherein triggering a null cycle comprises triggering a sequence of null cycle and the method further comprising, after a final null cycle in the sequence of null cycles, printing the next color separation.

11. A method as in claim 7, wherein applying wet null voltages comprises applying wet null voltages to each of a plurality of non-forecast binary ink developers.

12. A method as in claim 7, wherein triggering a null cycle comprises receiving an interrupt signal from a printing subsystem indicating the subsystem is not ready to continue the printing.

13. A non-transitory machine-readable storage medium storing instructions that when executed by a processor of a printing device, cause the printing device to:

trigger a null cycle during a printing session after transferring a color separation from the print blanket to a print substrate and before transferring a next color separation to the print blanket;

maintain printing voltages on a forecast binary ink developer that has been prepared to print the next color separation onto a photoreceptor;

apply wet null voltages to a non-forecast binary ink developer; and during the null cycle, transfer fluid other than ink from the non-forecast binary ink developer to the photoreceptor and from the photoreceptor to the print blanket.

14. A non-transitory machine-readable storage medium as in claim 13, wherein the wet null voltages have the same polarity as the printing voltages and a magnitude that reduces the strength of the corresponding electric field compared to the printing voltages.

15. A non-transitory machine-readable storage medium as in claim 13, storing instructions to select the non-forecast binary ink developer based on the last color separation printed.

16. A non-transitory machine-readable storage medium as in claim 13, storing instructions to:

determine a color of the last color separation printed; and select the non-forecast binary ink developer whose color does not immediately follow the color of the last color separation printed in the normal order for printing color separations.

* * * * *